US005829964A

United States Patent [19]

Derrick et al.

[11] Patent Number: 5,829,964

[45] Date of Patent: Nov. 3, 1998

[54] FLARE LINE GAS PURGE SYSTEM

[75] Inventors: Buddy L. Derrick; Gunther von Gynz-Rekowski, both of Houston, Tex.

[73] Assignee: Pegasus International Inc., Cayman Islands

[21] Appl. No.: 876,791

[22] Filed: Jun. 16, 1997

[51] Int. Cl.[6] ..... F23D 14/00

[52] U.S. Cl. ..... 431/202; 431/5

[58] Field of Search ..... 431/5, 202, 29

[56] References Cited

U.S. PATENT DOCUMENTS

| | | | |
|---|---|---|---|
| 3,741,713 | 6/1973 | Reed . | |
| 3,859,033 | 1/1975 | Buchanan et al. . | |
| 3,901,643 | 8/1975 | Reed et al. . | |
| 3,994,663 | 11/1976 | Reed . | |
| 4,025,281 | 5/1977 | Lapp . | |
| 4,120,638 | 10/1978 | Straitz, III . | |
| 4,127,380 | 11/1978 | Straitz, III . | |
| 4,139,339 | 2/1979 | Straitz, III . | |
| 4,265,611 | 5/1981 | Reed et al. . | |
| 4,516,932 | 5/1985 | Chaudot . | |
| 4,559,006 | 12/1985 | McGill et al. . | |
| 4,610,622 | 9/1986 | Quinnell | 431/202 |
| 4,634,369 | 1/1987 | McGill et al. . | |

*Primary Examiner*—Carroll D. Dority
*Attorney, Agent, or Firm*—Rosenblatt & Redano P.C.

[57] ABSTRACT

In the context of an oil and gas drilling rig flare system, a purge system is introduced so that in the event of a flammable gas release at the rig, the purge system can be activated. Activation of the system shuts off gas supply from a separator in the mud return system to the flare line and initiates a purge of an inert gas. Any ignition sources in the flare line are immediately turned off. The purging cools the flare line to a point where it cannot act as an ignition source itself. The inert gas prevents the presence of oxygen in the flare line to additionally prevent combustion within the flare line. The flowing inert gas cools the flare line to the point where it cannot ignite any escaping gas from the rig floor. The system can be manually or automatically actuated.

19 Claims, 1 Drawing Sheet

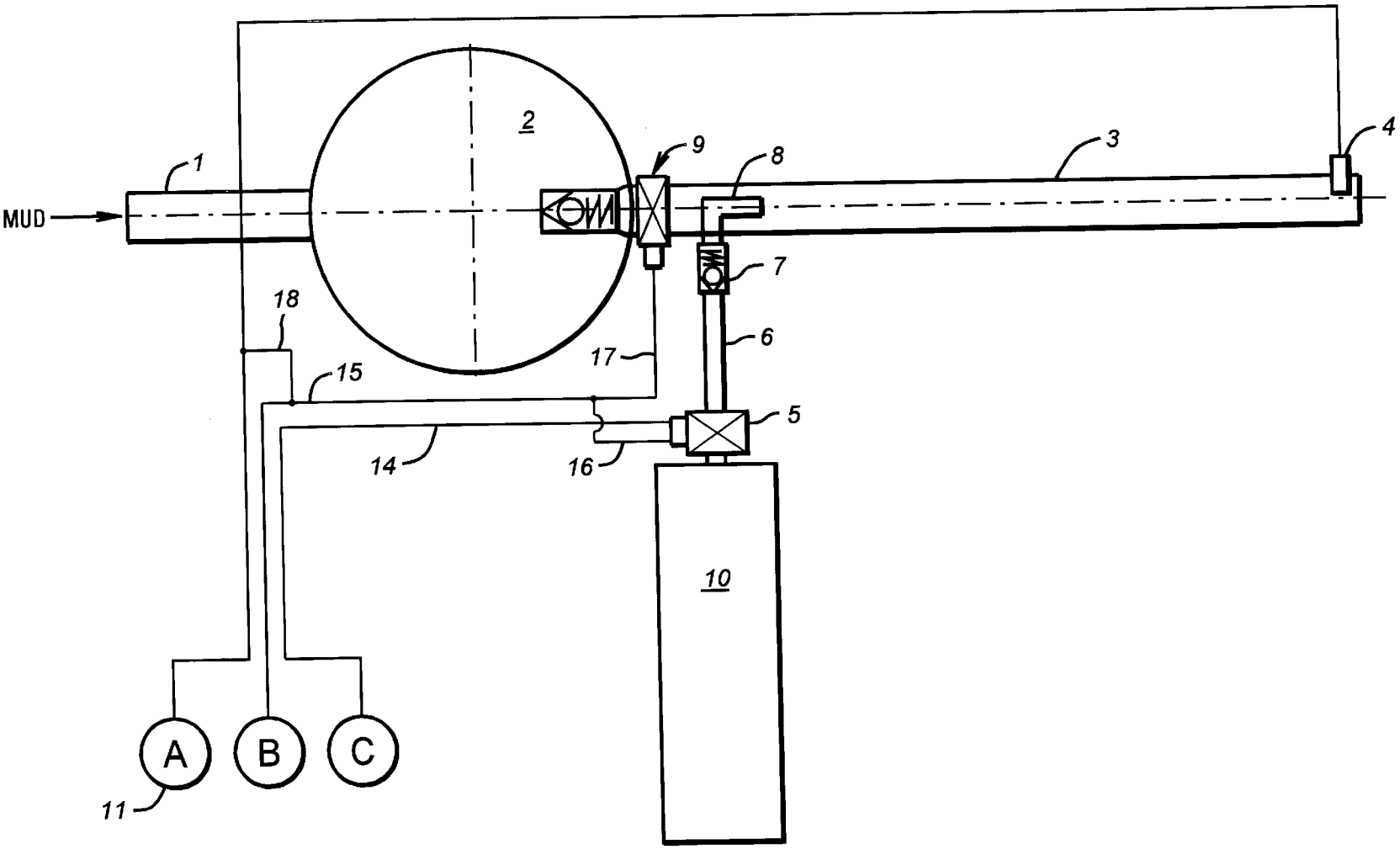
4
3
8
7
6
5
10
9
17
16
2
14
15
18
C
B
A
1
11
MUD

FLARE LINE GAS PURGE SYSTEM

FIELD OF THE INVENTION

The field of present invention relates to flare systems used at oil and gas drilling rigs and safety systems for such systems.

BACKGROUND OF THE INVENTION

During drilling, mud is circulated in the borehole and entrained gases which can be flammable are separated in a liquid/gas separator, also commonly referred to in the industry as a gas buster. The separated gases, also commonly specified in the industry as waste gases, exit the top of the gas buster and are generally directed down a long pipe which is oriented down-wind from the rig floor. This pipe is generally about 100 feet long or more and contains an ignition source at its tip. Any flammable gases which are released from the gas buster are burned at the tip of the flare line where the ignition source is mounted. This has been a standard set-up for drilling rigs for many, many years. One of the problems that has occurred occasionally with disastrous results has been a rig fire initiated by the flare system. The manner in which this occurs is as a result of a flammable gas leak at the rig like a gas blowout. When such a situation occurs, the prevailing winds generally carry the leaking flammable vapors in the direction of the flare line. While the flare line is desirably placed downwind so that the flames, the products of combustion, and smoke that emerge from its tip are blown by the prevailing winds away from the rig floor, an emergency situation at the rig floor involving leakage of flammable vapors is aggravated by the positioning of the flare line. The flare line is normally quite warm due to the combustion occurring at its tip and the temperature of the gases in any event coming from the wellbore.

Flare systems for oil and gas drilling rigs tend to be fairly simple systems that are devoid of anything but the simplest controls. Typically, an ignition source such as a pilot flame is provided at the outlet end of the flare line and is left on constantly so that, in the event the drilling activities produce any flammable gases that come out of the gas buster, the ignition source will start combustion of such vented gases. Thus, during normal operations, the flare line or at least portions thereof towards the outlet end are fairly warm.

In the event of an unforeseen release of flammable liquids or vapors at the rig, the prevailing winds carry such released flammable liquids or vapors toward to the tip of the flare line. In land-based rigs, the flare line is typically one that extends from near the rig floor nearly horizontally out a given distance downwind of the rig floor. This design is also seen in some offshore rigs. However, newer offshore rigs will tend to slope the flare line upwardly so that the ignition source is above the rig floor. In such newer offshore rig installations, the hottest point of the flare line, which is that section closest to the ignition source, is also higher than the rig floor with the hope that any leakage of fluid or gas from the rig area, even if blown downwind, will pass below the ignition source and that portion of the stack which is the hottest and will therefore not cause ignition. However, even this layout in the offshore rigs does not give assurances that a leakage of sufficient quantity of flammable liquid or gas at the rig, coupled with certain weather conditions, will not carry the flammable gas to the ignition point or the hot portion of the flare stack causing a fire to come back to the rig. Once any ignition of leaking fluid or gas occurs on or outside of the flare stack, the fire will follow a path back to the rig to the source of the leakage. This has resulted in flames coming back to the rig floor, causing property damage such as melting down the steel structures and severe personal injury and death. Even though these types of accidents have happened repeatedly, the systems on drilling rigs have not addressed this issue, thus creating a possibility that this scenario could be repeated in the future.

It is thus an objective in this invention to take simple flare systems that are typically used in oil and gas drilling or workover operations and add a low-cost system which will allow rig personnel to eliminate the danger of ignition of escaping flammable vapors. The system is simple to use and, when properly used, timely eliminates the potential ignition source from the flare line in the event of a flammable gas release at the rig floor.

The simplicity of the present design is to be contrasted with prior designs used primarily in industrial process plants such as oil refineries. For example, U.S. Pat. No. 4,139,339 illustrates a complex purge system which takes into account variables such as wind speed, waste gas flow in the stack, ambient temperature, and temperature of the advancing gaseous medium in the stack, as well as oxygen content at predetermined locations in the stack. The system disclosed in this patent is far too complex for a typical drilling rig and adds significant cost as well as potential operational problems due to the complexity. Yet another complex flaring system is illustrated in U.S. Pat. No. 3,901,643. In this system, the purge flow of gas is regulated according to the temperature of the gas in the flare system as well as the pressure in the flare system. Thus, when the temperature is high and the pressure normal, the purge gas is supplied to control the temperature. If the temperature and pressure are both high, the purge gas is cut off. Again, these very complex systems are ill-suited for onshore/offshore rigs which must be disassembled and moved to different locations for drilling or workover of subsequent wells.

In this environment, the apparatus and method of the present invention allows for the use of a simple system which is reliable and which can be manually actuated in the event of a leak of fluid or gas or automatically actuated by sensing leakage of combustible fluid or gas or, for that matter, any other liquid or gas that is detectable.

SUMMARY OF THE INVENTION

In the context of an oil and gas drilling rig flare system, a purge system is introduced so that in the event of a flammable gas release at the rig, the purge system can be activated. Activation of the system shuts off waste gas supply from a separator in the mud return system to the flare line and initiates a purge of an inert gas in the flare line The flow of inert gas in the flare line quickly creates a composition in the flare line that will not support combustion or allow an explosion to occur. This can mean that only inert gas is in the flare or some mixture with the inert gas which will not support combustion. Any ignition sources in the flare line are immediately turned off. The purging quickly cools the flare line to a point where it cannot act as an ignition source. In the preferred embodiment, the inert gas will completely fill the flare line and therefore replace waste gas in the flare line. The inert gas prevents the presence of oxygen in the flare line to additionally prevent combustion within the flare line. The flowing inert gas cools the flare line to the point where it cannot ignite any escaping gas from the rig floor. The system can be manually or automatically actuated.

BRIEF DESCRIPTION OF THE DRAWINGS

The FIGURE illustrates a schematic representation of a quick purge system for an oil and gas drilling or workover rig.

DETAILED DESCRIPTION OF THE PREFERRED EMBODIMENT

According to the FIGURE, the mud return line 1 carries back fluids from the well into a separator 2 where the liquids exit the bottom and the waste gases, some of which can be flammable, exit the top through a flare line 3. The flare line 3 has an ignition source 4 which is schematically illustrated by a switch or control labeled A. The ignition source 4 can be electronic or it can be a pilot light operated with gas or any other equivalent ignition source. During normal operations, the ignition source 4 is maintained constantly in the on position through use of switch 11.

Located in the flare line 3 is a combination on/off check valve assembly 9. The on/off portion of this valve assembly 9 is a butterfly valve or ball valve or some other quick closing valve which is left in the normally opened position during normal operations. The check valve portion which is illustrated schematically as a spring-loaded ball prevents gases from moving up the flare line 3 toward the separator 2. Downstream of the on/off check valve assembly 9 is a nozzle 8 pointing toward the ignition source 4. A check valve 7 is mounted in purge line 6 such that when purge valve 5 is opened, flow commences from storage vessel 10 into flare line 3. Check valve 7 prevents waste gas from entering purge line 6. Storage vessel 10 typically carries a non-combustible pressurized inert gas, preferably nitrogen. The valve 5 is controlled by switch B. When switch B is actuated, it accomplishes several tasks: the on/off valve 9 is closed and purge valve 5 is opened while the ignition source 4 is cut off. What results is a quick, within a few seconds, purging of flare line 3 with inert gas from the storage vessel 10 without any further admission of flammable vapors into the flare line 3 as a result of the closing of on/off valve 9. Switch C is made available for manual actuating of the purge valve 5. Accordingly, line 14 extends from switch C to the valve 5 via branch 16 and 17 to schematically indicate that actuation of switch B opens valve 5 and closes valve 9. Additionally, line 18 illustrates schematically that actuation of switch B also cuts of the ignition source 4.

During normal rig operations, the valve 5 is closed and the valve 9 is opened, allowing separated waste gases from separator 2 to exit into the flare line 3 where any flammable waste gases are consumed by the ignition source 4. The purge system can be tested periodically by actuating switch C. Actuating switch C will open valve 5 to produce a flow of nitrogen or other inert gas through the nozzle 8 down the flare line 3 without any other activity occurring.

In the event of an emergency at the rig involving a gas or liquid release, whether flammable or not, switch B is actuated which overrides the ignition source 4, closing it off while at the same time closing valve 9 and opening valve 5. Switch B can be manually activated or it can be tied into a flammable gas detector which will set off switch B automatically as well as sound an audible alarm. Flow is immediately begun into the flare line 3 through nozzle 8. The flow of inert cool gases through the flare line 3 cools the flare line down and ensures that no oxygen can enter the flare line as it is cooled down. Additionally, the ignition source 4, having been cut off in conjunction with a rapid cool down of the flare line 3, precludes the availability of the flare line 3, or its ignition source 4, as a source of ignition to the escaping gas from the rig. Since the flare line 3 is normally situated downwind, it is important to be able to cool the flare line 3 immediately upon detection of any escaping flammable gas. It is important to cut off the ignition source in the flare when the wind is likely to bring toward the flare line flammable gas which can be ignited. Ignition of any escaping gas from the rig in the area of the flare line can cause a fireball to come back to the rig with devastating results which involve complete destruction of the rig and loss of life for rig personnel.

Despite the existence of very elaborate controls for vertical flare systems used in hydrocarbon processing plants, as illustrated for example in U.S. Pats. No. 4,265,611; 4,126,038; 4,139,339; 4,559,006; 4,634,369; 3,901,643; 4,025,281; 3,859,033; 4,127,380; 3,741,713; and 4,516,932, none deal with the situation as described above. Since rigs are routinely assembled and disassembled for each location, a flare system is required that is easy to put together and has a simple and reliable system to assure safety of the rig operating personnel. The flare system for oil and gas drilling rigs of the present invention is simple in its routine operation and, as a result, the proposed invention, to be added to the flare system for oil and gas drilling or workover operations, is also economical, easy to install, and reliable in its operation. Despite the existence of numerous control systems for vertical flare stacks used in hydrocarbon processing plants, this technology has not been in the past adopted for simple flare systems for oil and gas. As a result, numerous fires have occurred with a resultant loss of life and property damage. The present invention was conceived to remedy the long-felt need in the oil and gas drilling industry for a purge system for a rig flare which eliminates the potential dangers of fire and explosion upon an inadvertent or accidental discharge of flammable gas.

The foregoing disclosure and description of the invention are illustrative and explanatory thereof, and various changes in the size, shape and materials, as well as in the details of the illustrated construction, may be made without departing from the spirit of the invention.

We claim:

1. In a flare system for a drilling or workover rig which comprises a flare line extending from a separator and an ignition source for burning waste gas or liquid coming from the separator, the improvement comprising a safety system further comprising:

and on-off valve in said flare line, a source of inert purge gas connected to said flare line adjacent said on-off valve;

a control system operably connected to said source of purge gas to allow for selective cooling of said flare line with purge gas flow in the event of a fluid or gas leak at the rig, said control system closing said on-off valve to prevent entry of gas or liquid into the flare line from the separator when purge gas is flowing so that waste gas or liquid is quickly displaced from said flare line.

2. The assembly of claim 1, wherein:

said control system actuates at least one switch which shuts off said ignition source as it opens said purge gas flow.

3. The assembly of claim 2, wherein:

said flare line comprises a check valve to prevent flow from said flare line into said separator.

4. The assembly of claim 3, wherein:

said check and on/off valves are mounted in close proximity to said separator.

5. The assembly of claim 4, wherein:

said source of purge gas further comprises a storage vessel and a purge line extending to said flare line, said purge line comprising a purge valve controlled by said control system.

6. The assembly of claim 5, wherein:

said purge line terminates in said flare line in a nozzle with an outlet facing away from said on/off valve.

7. The assembly of claim 6, wherein:

said purge line comprises a check valve.

8. The assembly of claim 6, wherein:

said control system controls at least one switch which allows testing of purge flow by opening said purge valve with said on/off valve open.

9. The assembly of claim 2, wherein:

said control system allows independent on or off activation of said ignition source; and said control system is actuated automatically by a flammable gas detector.

10. A method of preventing rig fires caused by fluids or gases inadvertently discharged around a rig from a well, comprising:

sensing a fluid or gas leak at the rig;

isolating a rig flare line from its associated mud return equipment by means of an on/off valve in said flare line;

turning off a normal ignition source in the flare line;

purging the flare line by injecting an inert purge gas adjacent said on-off valve.

11. The assembly of claim 10, wherein:

creating an environment where burning or explosion cannot take place by rapid displacement of the flare line contents with said purging.

12. The assembly of claim 11, wherein:

using a control system which can be actuated manually or automatically upon sensing of a gas or liquid leak near the rig to accomplish the isolation of the flare line, turning off of the normal ignition source and purging of the flare line which cools it.

13. The assembly of claim 12, wherein:

controlling an on/off valve adjacent a returning mud gas/liquid separator with the control system.

14. The assembly of claim 13, wherein:

providing an opening at the end of said purge line directed toward the outlet of the flare line.

15. The assembly of claim 14, wherein:

providing a check valve on the purge line adjacent its point of entry into the flare line.

16. The assembly of claim 15, wherein:

providing a check valve on the flare line between the on/off valve and the mud return equipment.

17. The assembly of claim 12, wherein:

configuring the control system to allow independent on/off operation of the ignition source as well as automatic actuation based on a signal received from a flammable fluid or gas detector.

18. The assembly of claim 17, wherein:

configuring the control system to allow independent operation of a purge valve in a purging system used for purging the flare line.

19. The assembly of claim 18, wherein:

using nitrogen gas as said inert gas for purging the flare line.

* * * * *